US005145184A

United States Patent [19]

Yearick et al.

[11] Patent Number: 5,145,184

[45] Date of Patent: Sep. 8, 1992

[54] BOARD GAME

[75] Inventors: David J. Yearick, Freeville, N.Y.; Timothy W. Walsh, Sarasota, Fla.; Edward J. Muccini, Douglaston, N.Y.

[73] Assignee: Big Fun A Go Go, Inc., Freeville, N.Y.

[21] Appl. No.: 657,061

[22] Filed: Feb. 15, 1991

[51] Int. Cl.[5] ..... A63F 3/00

[52] U.S. Cl. ..... 273/248; 273/285; 273/431

[58] Field of Search ..... 273/243, 248, 249, 285, 273/287

[56] References Cited

U.S. PATENT DOCUMENTS

| | | | |
|---|---|---|---|
| 52,891 | 2/1866 | Schaefer | 273/285 |
| 1,903,661 | 4/1933 | Storey | 273/248 |
| 2,729,451 | 1/1956 | Larson | 273/285 |
| 4,527,800 | 7/1985 | Samansky | 273/285 |
| 4,625,970 | 12/1986 | Childs et al. | 273/257 |
| 4,736,954 | 4/1988 | Haney et al. | 273/236 |
| 4,856,780 | 8/1989 | Begley et al. | 273/244 |
| 4,998,735 | 3/1991 | Blackwell, III | 273/249 |
| 5,014,995 | 5/1991 | Woodward | 273/285 |

FOREIGN PATENT DOCUMENTS 2187393 9/1987 United Kingdom ..... 273/249

OTHER PUBLICATIONS

Trivial Pursuit—Master Game—Rules of Play, 1981, Horn Abbot Ltd., Selchow & Righter Co.

Games Magazine, Pictionary, Mar. 1986, p. 48.

*Primary Examiner*—Edward M. Coven

*Assistant Examiner*—Steven Wong

*Attorney, Agent, or Firm*—Wall and Roehrig

[57] ABSTRACT

A board game combines elements of chance, strategy, and mental ability to connect or bond a sequence of clues. A triangular game board is divided into three quadrilateral playing areas, each with a peripheral game path consisting of squares or spaces. Each player has three transit pieces, one for each of the three pathways. A category die is rolled to select a particular category or obtain a free roll. There is a set of clueset cards, with each card having on its front face a clueset for each of the categories, and, in addition, a challenge clue set. On the reverse are answers to the category clue sets. The game board folds compactly for storage.

15 Claims, 4 Drawing Sheets

BOARD GAME

BACKGROUND OF THE INVENTION

This invention relates to parlor games and more specifically to board games in which players move transit pieces along a game path. The invention is more particularly directed to a board game that combines the elements of chance, strategy, and the mental ability to connect or bond a series of clues.

Numerous games have been proposed in which the players move pieces along one or more pathways which are divided into playing stations, spaces, or squares. Each player has at least one transit piece, sometimes called game piece, man, or marker, that is moved along the pathway from one station to another a number of spaces based on the roll of a die, the draw of a card, or some other means of selecting a random number. Many games also involve questions or clues from a range of categories, to which a player must answer correctly to move a piece or to continue play. Many of these parlor games are question-and-answer trivia games. Most of these games involve moving a single piece along a single pathway and so there is little option for strategy in movement of the transit pieces. Also, in many of these games, the question category depends upon which space the player has landed, and this limits the variety and challenge of the game.

Previous question and answer games have involved asking specific questions to solicit knowledge of specific facts. Thus, no games of this type have been proposed which call for players to find a common element or bond for a set of clues. Previous question-and-answer games have not provided opportunities to challenge players' transit pieces that are not on the same square to be occupied by the challenging player's transit piece.

OBJECT AND SUMMARY OF THE INVENTION

Accordingly, it is an object of this invention to provide an educational, amusing and challenging game which combines elements of strategy, skill, and chance.

It is another object to provide a game that combines verbal skills and wide general knowledge with strategy of chase and set back.

It is a further object to provide a board game that challenges the players' ability to link or bond multiple-clue sets by identifying the common bonding feature of the clueset for a given category.

According to an aspect of this invention, the game apparatus comprises a triangular game board that is divided into three playing areas. Each of these playing areas is a quadrilateral that occupies a third of the board from the center out to a respective corner of the board. The three areas each have a game pathway that extends around their periphery and consists of a sequence of playing squares or spaces that function as stations for the transit pieces. Some of the spaces are specially marked or colored, and serve as challenge spaces. Each player is provided with three transit pieces which travel respectively on the three pathways, starting and ending on a central triangle in the center of the game board. There is a conventional die (with one spot to six spots on its six faces) and a special category die with category symbols on five of its six faces. A sixth face of the category die carries another symbol to indicate free roll—that is, the player in question does not have to bond a clueset.

The game set also comprises a box of clueset cards. On the front side of each card are several cluesets, with one clueset for each of several categories, and there is also a challenge clueset. On the reverse side are the answers to the several cluesets. Each clueset is a group of three words, terms, or phases, which share some common bonding characteristics, related to the category in question. For example, for the category of Sports and Recreation, a clueset may be, for example, "Concrete, Clay, Grass", for which the correct answer is "Tennis Court Surfaces."

A challenge can be initiated by a player attempting to move a transit piece to a space occupied by another player, by landing his or her piece on a challenge space, or by a challenge command found on a number of the cards in the card box. In either case, the challenging and challenged (i.e. defending) player simultaneously attempt to respond to a challenge clueset read aloud by a third player. If successful, the challenging player changes positions of his or her game piece with that of the other player. If unsuccessful, the turn ends for the challenging player and the play goes to the next player.

Play ends after one of the players has moved all three of his or her transit pieces around the respective pathways and back into the central triangle.

During play, each player has three options as to which piece is to be moved, and can initiate a challenge or not, depending on the desired strategy.

The game board is formed of four triangular panels with one central panel that is hinged to the other panels serving as corners. This permits the game board to fold compactly for storage and to open easily for play.

While the game set and rules of play are both rather simple and easy to use, the game itself provides countless hours of challenging entertainment.

The above and many other objects, features and advantages of this invention will be more fully understood from the ensuing description of a preferred embodiment, which is to be read in connection with the accompanying Drawing.

DETAILED DESCRIPTION OF A PREFERRED EMBODIMENT

Figure 1:
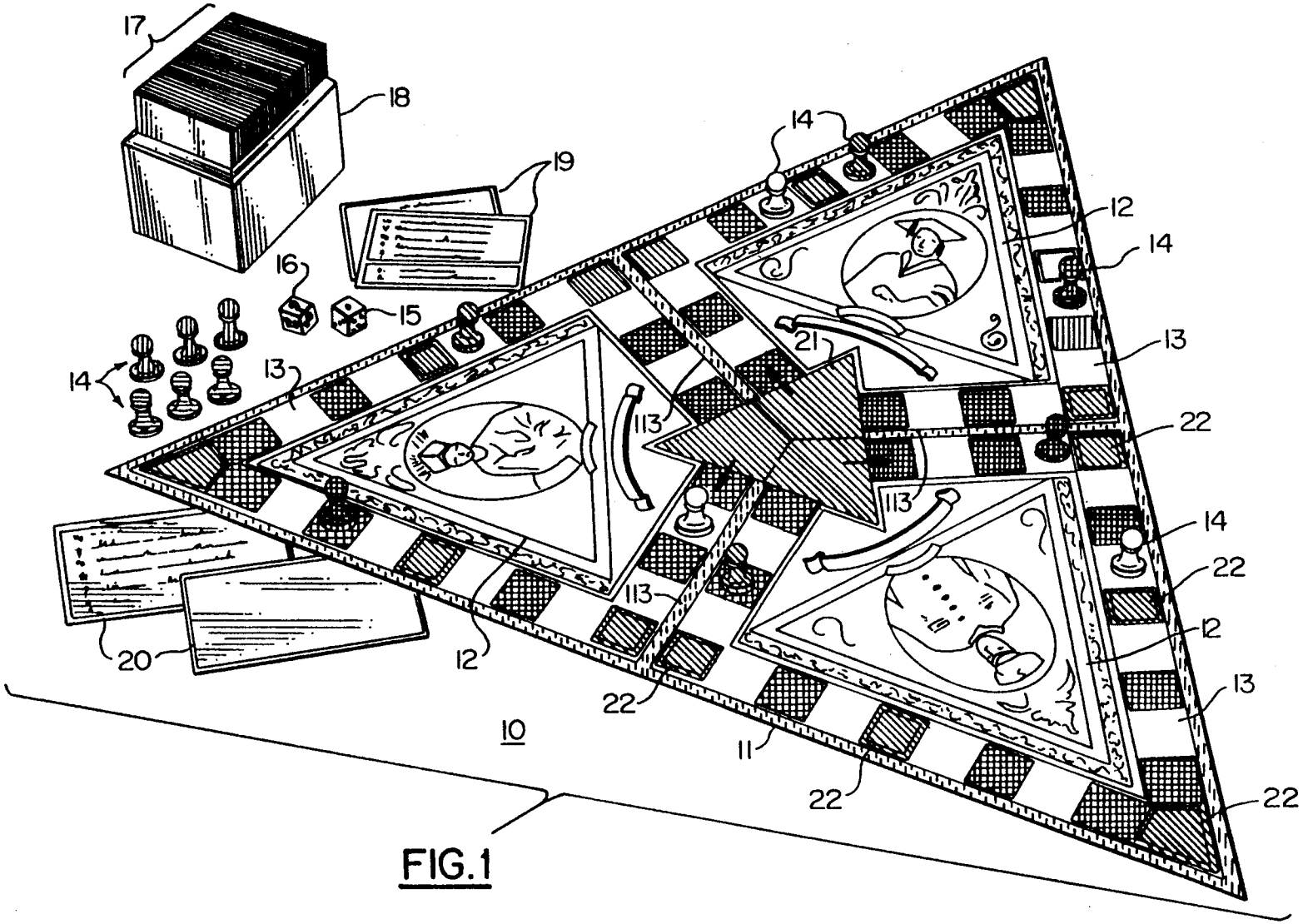
FIG. 1 is a perspective view of game apparatus according to an embodiment of this invention.
Figures 2, 4A, 4B:
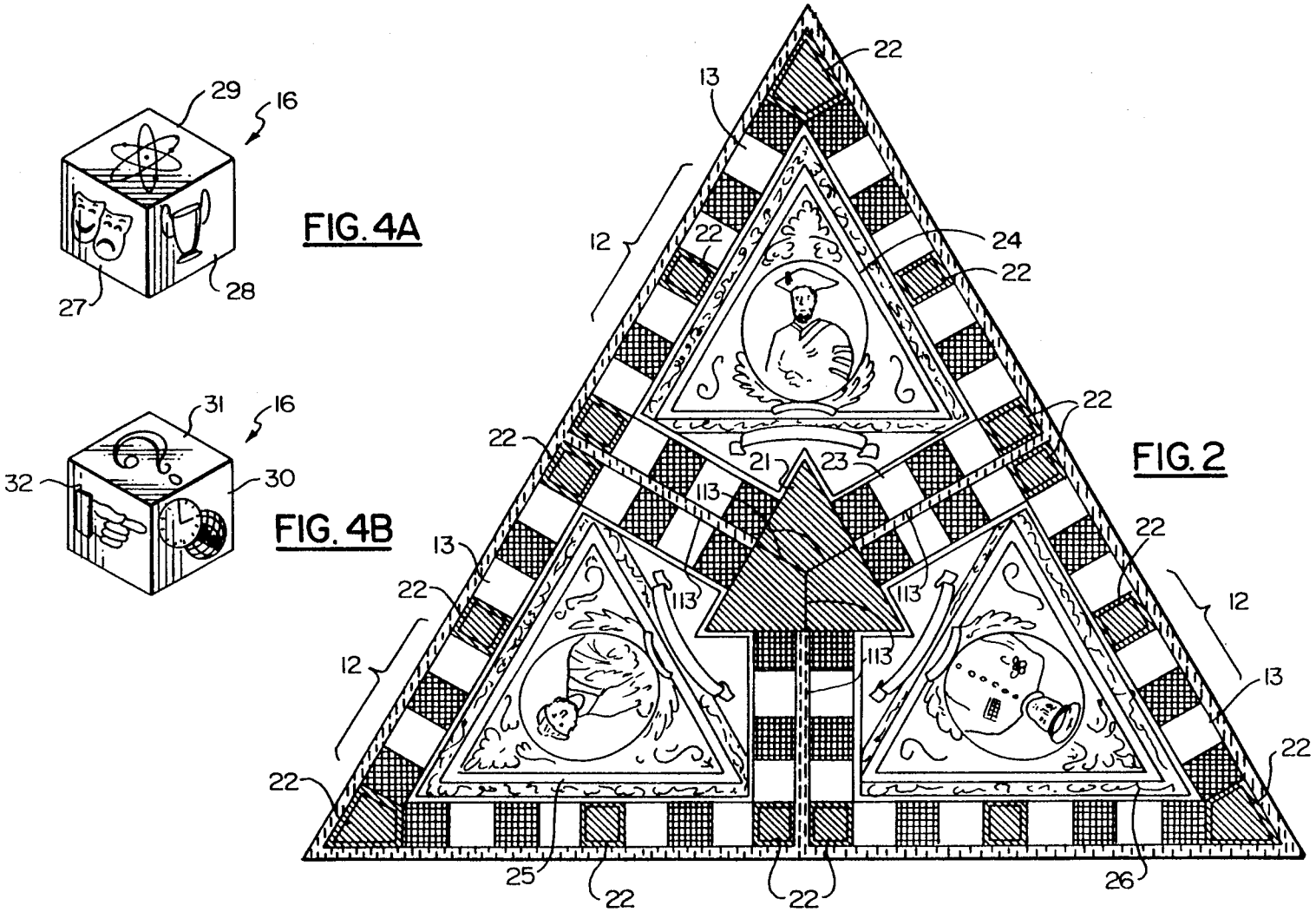
FIG. 2 is a plan view of the game board of this embodiment.
FIGS. 4A and 4B are perspective views of a category die of this embodiment, which together show the six die faces.

With reference to the Drawing, and initially to FIG. 1, a game set 10 of this invention has a generally triangular game board 11 here in the form of an equilateral triangle. The board 11 has a playing surface divided into three similarly shaped playing areas 12, one playing area for each of three noble human graces or virtues attributes, namely integrity, knowledge and strength. As also shown in FIG. 2, each of the playing areas 12 is in the shape of a quadrilateral, with one corner coincident with a respective corner of the triangular board 11, and with another corner at the center of the board. Here the quadrilaterals are each 60 degree, 90 degree, 120 degree, 90 degree quadrilateral. Each of the playing areas has a peripheral closed loop pathway 13 formed of a sequence of spaces or stations. A boundary line or stripe 113 is interposed between each triangular playing area 12 and the two adjacent areas 12 to structurally segregate the three playing paths 13 one from another. Each player is provided with a group of three transit pieces 14, with one transit piece for each player traveling along a respective one of the three pathways 13. Each of the three pieces 14 for each respective player can be distinctively colored or marked or can have a distinctive shape. In this embodiment, there are three pieces 14 of each color, namely, red, orange, yellow, green, and blue.

The game set 10 also includes a standard die 15, with one spot to six spots on its respective faces. The die 15 is rolled for randomly determining the number of spaces that a transit piece 14 is entitled to move along a given pathway 13.

The game set 10 also includes a category die 16 which is rolled to select question categories for the players to respond to.

A card set 17 contains from 400 to 1200 clueset cards. These are retained in a card box 18 and two typical clueset cards 19 are shown lying alongside one edge of the board 11. There are also rule cards or category cards 20 provided for informational purposes to assist the players in playing the game.

As also shown in FIG. 2, there is a central triangle 21 that is common to the three pathways 13 and which serves as a home location for the transit pieces 14. This triangle 21 is divided into three quadrilaterals, with each of the players initially placing his or her respective pieces 14 in the three areas. During play, the central triangle 21 serves as the starting point and ending point for the respective game pathways 13.

As also shown in FIG. 2, on each of the pathways there are five challenge spaces 22. These are colored green in this embodiment, but in other versions could have other configurations and could vary in number.

Figure 3:
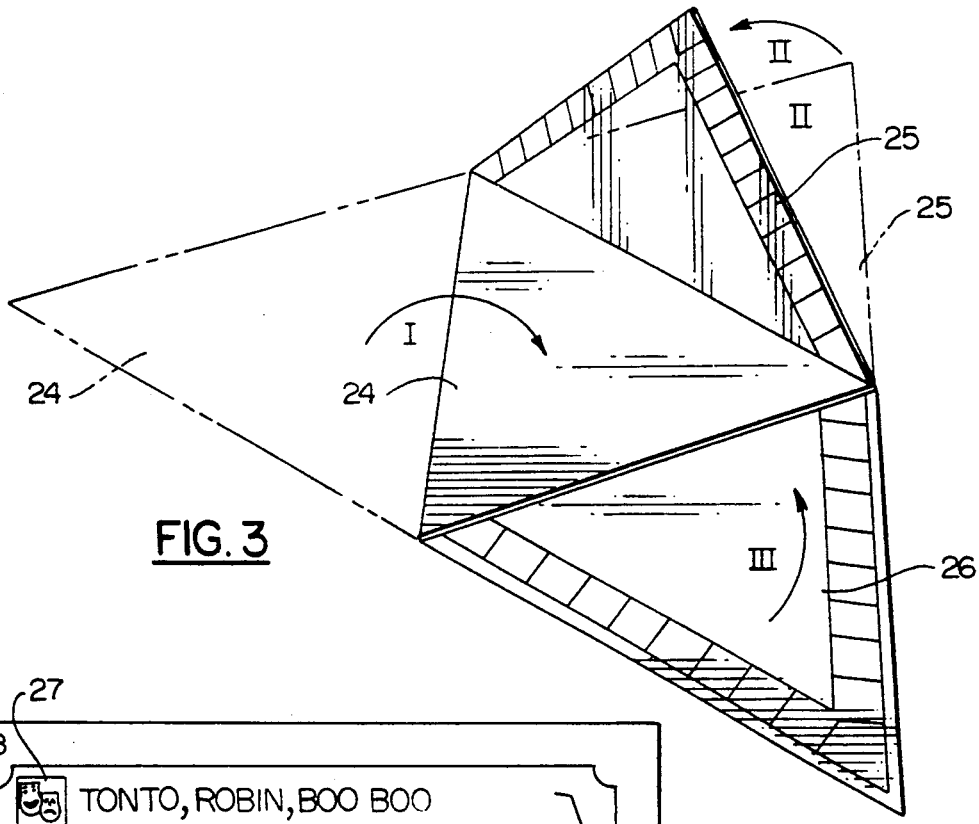
FIG. 3 is a perspective view of the game board shown being folded for storage.

As shown in FIG. 2 and with further reference to FIG. 3, the game board 11 is adapted for opening out to form a large playing surface, and is foldable for compact storage. In this case, the board 11 has a central triangular panel 23 and three corner triangular panels 24, 25, and 26. Each of the latter corner panels 24, 25, 26 is hinged to a respective side of the central panel 23. The panels 24, 25, and 26 fold in one at a time, on top of the center panel 23.

Detail of the category die 16 is shown in FIGS. 4A and 4B. Here the die 16 has six faces, each of which carries a symbol to identify a category to which the player in his or her turn is to respond. Three of the faces are shown in FIG. 4A and the remaining faces (which are obscured in that view) are shown in FIG. 4B. The faces shown in FIG. 4A show symbols 27, 28 and 29 for an "arts and entertainment" category, a "sports and recreation" category, and a "science and technology" category. The three faces shown in FIG. 4B carry symbols 30 and 31 to identify a "history and geography" category and a "miscellaneous" category. The remaining face carries a "free roll" symbol 32, the function of which is discussed later.

Figure 5A:
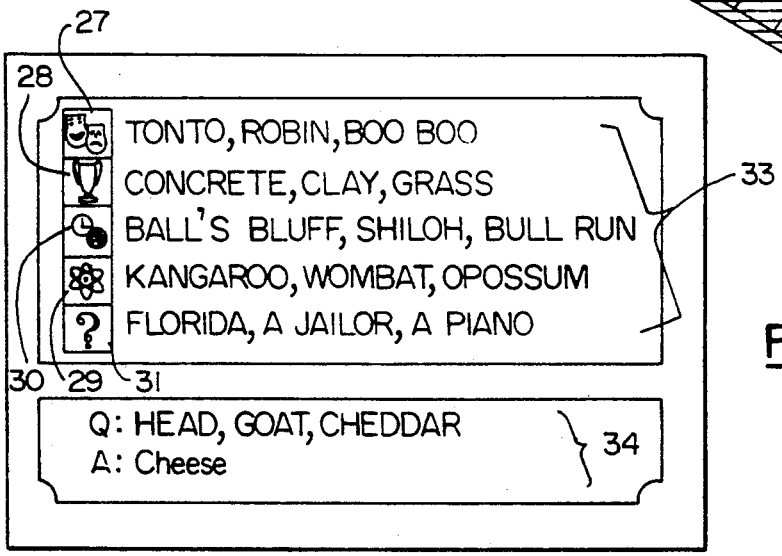
FIGS. 5A and 5B are front and rear views, respectively, of an example clueset card as employed in this embodiment of the invention.
Figure 5B:
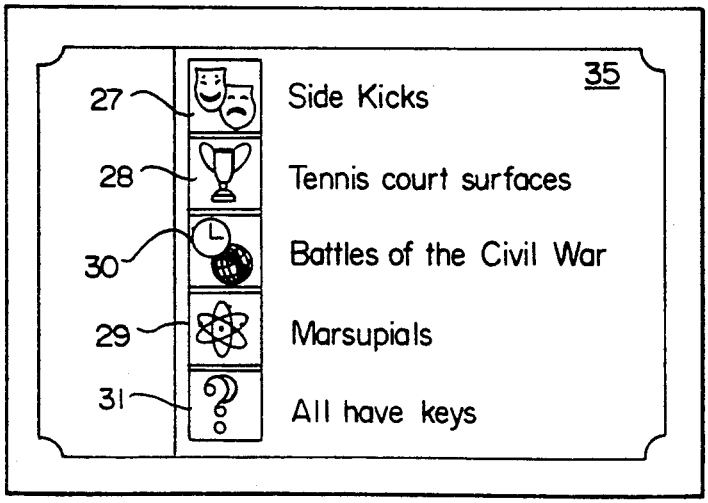

A typical one of the clueset cards 19 is shown in FIGS. 5A and 5B, which depict the front side and reverse side respectively. The front side of the card 19 contains question cluesets 33, with one three-term clueset for each category as identified by the symbols 27–31. At the lower part of the card 19 there is also a challenge clueset and answer 34. On the reverse side of the card 19 are set of answers 35 to the cluesets 33 that appear on the front of the card. Each of these answers is identified by an associated category symbol 27–31. Here, the free roll symbol 32 does not appear on the card 19.

The object of the game is to bring the game pieces 14 out from the center triangle 21 and along the three respective game paths 13, and then back to the center triangle 21. To do this, the players, during their turn, answer or "bond" cluesets 33 which are lists of three clues that have a specific "bond" that is, a specific relationship or common characteristic. For example, for a clueset "Q: Michigan, Ontario, Erie" the answer would be "A: Great Lakes". Other examples of cluesets and answers are shown in the card depicted in FIGS. 5A and 5B. The players can play individually or in teams. Each player chooses three of the same color pieces 14 to represent, for example, a scholar, a soldier, and a saint (i.e. the virtues of knowledge, strength, and integrity). Each of the games pieces is placed in the part of the center triangle 21 for its respective pathway 13. The game transit pieces 14 are moved clockwise, and there is only one game piece 14 for each player or team on any one of the three pathways 13.

To commence play, the standard die 15 is rolled. The player or team with the highest roll plays first, with the play passing clockwise.

In each player's or team's turn, the category die 16 is rolled first to determine from which category the clueset 33 from a card is to be read. This is done by matching the symbols on the die 16 to the symbols on a clueset card 19. The category card 20 can be referred to for category definition and explanation at any time during the game. The category is determined by the roll of the die 16, independent of what station the transit pieces 14 may occupy at the time.

After the category die 16 has been rolled, another player then draws a clueset card 19 from the box 18 and reads the appropriate cluesets aloud. The clueset is read one clue at a time, and in the order in which they appear on the clue-set card 19. If the player responds by correctly "bonding" the three clues of the clueset 33, thus creating a "tribond", that player (or team) can then roll the standard die 15 and move any one of the three game pieces a number of stations equal to the number of spots appearing on the top of the die. The other player then replaces the card 19 in the back of the box 18 and the play continues. The player's turn or team's turn is over when a clueset is incorrectly answered.

If the category die 16 lands with the free roll symbol 32 on top, then the player can roll the standard die 15 and move one of the three pieces 14 without having to answer any clueset.

A challenge sequence can arise during play under several circumstances.

If a player chooses to move his or her game piece onto a station or space that is already occupied, then a challenge sequence is initiated. These challenges may occur at any space on the board 11 except for the center triangle 21. The player who moves onto the occupied space is the challenger, and the player occupying that space is the defender. A neutral player then draws a clueset card 19, and reads the challenge clueset 34 that appears at the bottom of the card. This clue is to be read slowly, pausing momentarily, i.e. for a few seconds, between each of the three clues. During this time, the challenger and defender may speak out guesses and these guesses may continue until one or the other of the challenger or defender gives the correct response. There is no penalty for incorrect guessing. If the challenger answers correctly first, then the defender moves back to the challenger's previous space and the challenger continues with his or her turn. If the defender wins, the defender's transit piece maintains its position, and the challenger's game piece returns to its previous space. This ends the turn for the challenger. If neither the challenger or the defender can correctly guess the correct answer to the clueset, it is considered a victory for the challenger.

Alternatively, a green challenge space sequence can be initiated. As previously mentioned, there are five green challenge spaces 22 distributed along each of the three pathways 13. If a player lands upon a challenge space 22, that player may choose to challenge anyone ahead of him or her on that specific pathway 13. The play follows here as in the challenge sequence mentioned above. However, the green challenge space may be utilized only when it is first landed upon, and not after that players next turn, nor when a players transit piece is sent back to it after losing a challenge. A player may not utilize the green challenge space challenge sequence when the challenge space 22 is already occupied, as the previously-described challenge sequence would take precedence.

There is also a challenge command sequence.

Figure 6:
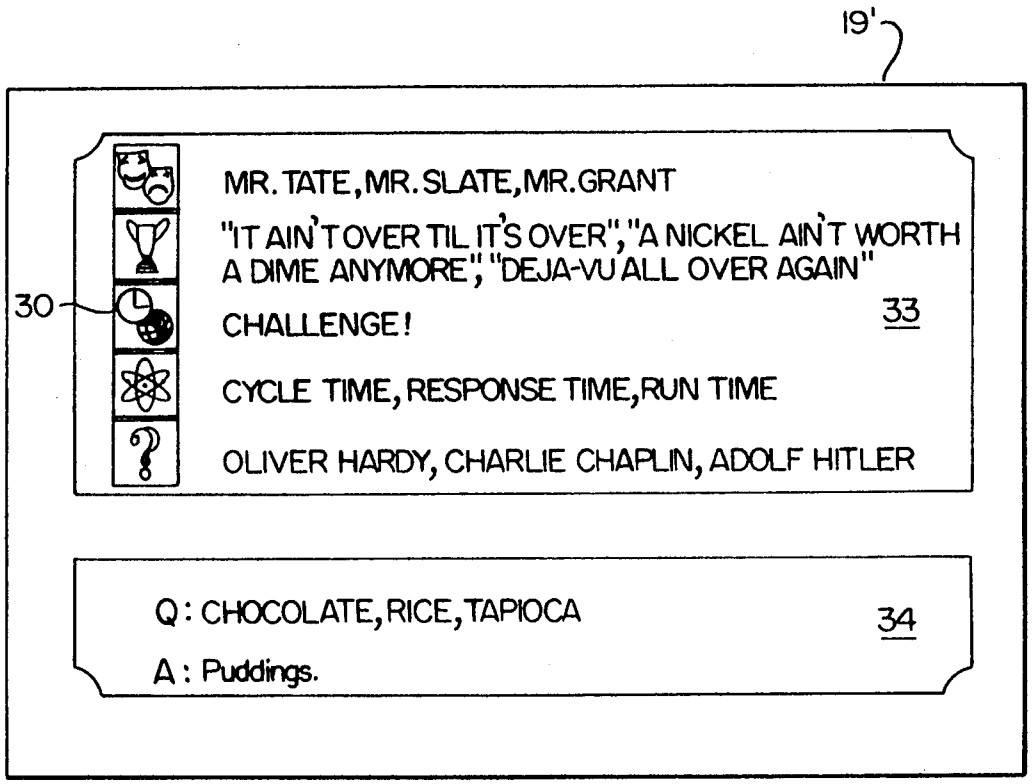
FIG. 6 shows another clueset card.

Placed randomly throughout the various clueset cards in the card set 17 there are challenge commands. A card 19' of this type is shown in FIG. 6. If, on a players turn, the term "challenge" appears instead of a clueset 33 opposite the particular one of the category symbols 27–31 that corresponds to the roll of the die 16, then that player must challenge someone else in the game. In this illustration, the challenge command appears with the history and geography symbol 30. The player may challenge anyone with a transit piece 14 ahead of him or her on any of the three pathways 13. Play follows here as in the above-described challenge sequences. However, a player or team will lose his or her turn in this challenge command sequence if there is no player with a piece 14 ahead of him or her on any of the three pathways 13, and thus having nobody to challenge. A turn is also lost if all three of the player's game pieces are safely within the center triangle, and the player is attempting to end the game.

The game ends when one player or team moves all three of the respective game pieces back into the center triangle, and then correctly answers a final clueset 33. If this clueset is incorrectly answered, the player or team maintains the three pieces 14 in the center triangle 21, and must await the next turn to attempt again. An exact roll of the die 15 is not required to enter the center triangle.

The rules can be varied somewhat to accommodate the desires of the players. Also, the cluesets 33 can include other categories, or additional categories besides those shown hereabove. Furthermore, challenges can be initiated in other circumstances, if desired. If four players are playing in teams of two, and a challenge is initiated, a player from each team can be elected to participate in the challenge, while one of the other players is considered neutral and reads the challenge clueset 34 aloud to the two players that act as challenger and defender. Also, the die 16 need not be a cube, as shown but could be another regular polyhedron.

Other rule modifications can make the game faster or more deliberate, as desired.

While this invention has been described with respect to a single preferred embodiment; it should be understood that the invention is not limited to that precise embodiment, rather, many modifications and variations would present themselves to those of skill in the art without departing from the scope and spirit of this invention, as defined in the appended claims.

What is claimed is:

1. Apparatus for playing a board game in which players move respective transit pieces on a board and are asked to solve cluesets pertaining to several categories, and whose object is for the players to correctly bond clues of the cluesets; the board game apparatus comprising:

a game board in the form of a triangle divided into three separate quadrilateral playing areas of similar shape and which each extend from a center of the game board to a respective corner, with three respective separate loop pathways thereon each formed of a succession of playing stations that proceed around the periphery of the respective playing area from a respective start of an end, including boundary means segregating each of the playing areas from each of the other playing areas;

a plurality of transit pieces equal to the number of players times the number of said playing areas, assigned three to each player, each of the three transit pieces of each player being moved along a respective one of the three pathways from start to end thereof;

an advancement randomizer device for generating, as a random number, the number of stations a player is to move a selected one of his or her transit pieces;

a plurality of clueset cards each with a front side and a reverse side, with the front side of each card containing a plurality of cluesets with one clueset for each of a predetermined number of categories, each clueset being a set of three bonded terms which have a common bonding characteristic, and with the reverse side thereof containing as answers the bonding characteristics for the respective cluesets; and a category randomizer device for randomly determining a category of cluesets to be answered by the player during his or her turn, with each category being represented by a respective symbol on a respective face of the randomizer device, the latter being the sole means to select the category, such that the category is selected independent of the stations occupied by the player's transit pieces, an including also an additional symbol on a respective face of the device not corresponding to a category but instead representing a free turn.

2. Board game apparatus according to claim 1, wherein said game board is in the form of an equilateral triangle and said three quadrilateral playing areas are each in the form of a 60° 120° 90° quadrilateral.

3. Board game apparatus according to claim 2 wherein said game board includes a center triangle serving as the start and finish for each of said three loop pathways.

4. Board game apparatus according to claim 1 wherein each said loop pathway includes a predetermined number of challenge stations which are distinctly marked and which permit a player whose transit piece advances to one of the challenge stations to challenge any other player who has a transit piece ahead of that station on the same pathway; and wherein each said clueset card contains in addition to the above-mentioned category cluesets a challenge clueset of three bonded terms to be answered by the first-mentioned player and by the challenged player in which both the challenge clueset and its respective answer both appear on the front side of the clueset card.

5. Board game apparatus according to claim 1 wherein the clueset cards each have respective category symbols thereon on the front side associated with the respective cluesets and on the reverse side associated with the respective answers, and wherein the category randomizer device has said category symbols on respective randomly selectable surfaces thereof.

6. Board game apparatus according to claim 5 wherein said category randomizer device is in the form of a regular polyhedron die having respective faces serving as said randomly selectable surfaces, and has one face carrying a free roll symbol not appearing on the clueset cards.

7. Board game apparatus according to claim 1 wherein said clueset cards each have in addition to the cluesets for said predetermined number of categories a challenge clueset of three terms having a bonding characteristic, the clueset to be read to a player during his or her turn and to another player having a transit piece ahead of the transit piece of the first mentioned player on a respective one of the pathways.

8. Board game apparatus according to claim 8 wherein selected ones of the clueset cards have on their front faces in place of the clueset, for one particular one of the categories, a challenge command to initiate a challenge when the category randomizer device determines that particular category at which the challenge command appears on the card.

9. Apparatus for playing a board game in which players move respective transit pieces on a board and are asked to solve cluesets pertaining to several categories, and whose object is for the players correctly to bond the clues of the cluesets, the board game apparatus comprising:

a game board in the form of an equilateral triangle divided into three similar quadrilateral playing areas which extend from a center of the game board to a respective corner thereof, with three respective loop pathways thereon formed of a succession of playing stations that proceed around the periphery of the respective quadrilateral playing area from a start to a finish, the game board being constructed of a first central triangular panel portion hingedly connected on its three sides to second, third, and fourth corner triangular panel portions, such that the board folds in for storage with the corner triangular portions folded in on top of the central triangular panel portion;

a plurality of transit pieces assigned respectively to each player to advance from said start to said finish on said pathways;

an advancement randomizer device for generating, as a random number, the number of stations a player is to move a selected one of his or her transit pieces;

a plurality of clueset cards, each with a front side and a reverse side with the front side containing at least one clueset, each said clueset being a set of three terms which have a common bonding characteristic, and with the reverse side containing a corresponding at least one answer thereto; and a category randomizer device for randomly determining a category of cluesets to be answered by the player during his or her turn.

10. A method of playing a board game whose playing apparatus includes a game board in the form of a triangle divided into three separate quadrilateral playing areas of similar shape and which each extend from a center of the game board to a respective corner, with three respective loop pathways thereon each formed of a succession of playing stations that proceed around the periphery of the respective playing areas from a respective start of an end, including boundary means segregating each of the playing areas from each of the other playing areas; a plurality of transit pieces equal to the number of playing areas times the number of players, assigned three to each player; an advancement randomizer device for generating as a random number the number of stations a player is to move a selected one of his or her transit pieces; a plurality of cluesets cards each with a front side and a reverse side, with the front side of each card containing a plurality of cluesets with one clueset for each of a predetermined number of categories, each clueset consisting of a set of three bonded terms which have a common bonding characteristic, and with the reverse side thereof containing as answers the bonding characteristics for the respective cluesets, and a category randomizer device for randomly determining a category of cluesets to be answered by the player during his or her turn; the method of play comprising for each one player in turn operating said category randomizer device being the sole means of determining the category regardless of the position of any of said transit pieces; another player reading aloud the three bonded terms of the clueset of that category from a clueset card; said one player responding to said clueset, and if responding correctly, actuating said advancement randomizer device, selecting one of the three transit pieces assigned to the one player and moving it along the respective pathway as indicated by the advancement randomizer device, and containing the steps of operating the category randomizer device, responding to a clueset, operating the advancement randomizer device, and moving a selected transit piece until one player cannot respond correctly to the clueset.

11. The method according to claim 10 wherein said category randomizer device includes a free-roll symbol, and when said one player in turn operates the category randomizer device to indicate the free roll symbol, said one player operates the advancement randomizer device immediately without first responding to any clueset.

12. The method according to claim 10 wherein each said clueset card includes a challenge clueset and answer in addition to said category cluesets, and when said one player's playing piece lands on a playing station already occupied by a second player's playing piece a challenge sequence is actuated; said one and second players responding at the same time while a third player reads aloud the bonded terms of the challenge clueset, and whichever of one and second player first responds correctly to the challenge clueset maintaining his or her transit piece on said playing station, the other player moving his or her transit piece back to a previous station on the respective loop pathway.

13. The method according to claim 10 wherein said challenge sequence is initiated by said one player advancing his or her transit piece to the station occupied by the second player's transit piece.

14. The method according to claim 10 wherein said challenge sequence is initiated by said one player advancing his or her transit piece to a specially designated playing station on said pathway.

15. The method according to claim 10 wherein certain ones of the clueset cards have on their front faces in place of the clueset for a particular one of said categories a challenge command to initiate said challenge sequence when the category randomizer device determines that the particular category at which the challenge command appears on the card; and said challenge sequence is initiated by said one player in turn operating said category randomizer to select said particular category in the turn where such certain one of the clueset cards is also selected.

* * * * *

UNITED STATES PATENT AND TRADEMARK OFFICE

CERTIFICATE OF CORRECTION

PATENT NO. : 5,145,184

DATED : September 8, 1992

INVENTOR(S) : Yearick et al.

It is certified that error appears in the above—identified patent and that said Letters Patent is hereby corrected as shown below:

Claim 1, column 6, line 54, please delete "an" and insert --and--

Claim 2, column 6, line 61 after 60° please insert --90°--

Claim 12, column 8, line 62 after of please insert --the--

Signed and Sealed this

Twenty-first Day of September, 1993

Bruce Lehman

*Attest:*

BRUCE LEHMAN

*Attesting Officer*

*Commissioner of Patents and Trademarks*